United States Patent [19]

Bettosini

[11] Patent Number: 4,896,895

[45] Date of Patent: Jan. 30, 1990

[54] SHOCK-ABSORBING ELEMENT FOR SKIS

[76] Inventor: Brosi Bettosini, Brunnenwiesenstrasse 28, 8610 Uster, Switzerland

[21] Appl. No.: 223,331

[22] Filed: Jul. 25, 1988

Related U.S. Application Data

[63] Continuation-in-part of Ser. No. 915,910, Oct. 7, 1986, abandoned.

[30] Foreign Application Priority Data

Mar. 25, 1982 [CH] Switzerland ..... 1850/82

[51] Int. Cl.[4] ..... A63C 5/00

[52] U.S. Cl. ..... 280/607; 280/618

[58] Field of Search ..... 280/601, 602, 607, 610, 280/11.14, 618, 617

[56] References Cited

U.S. PATENT DOCUMENTS

| | | | |
|---|---|---|---|
| 2,258,046 | 10/1941 | Clement | 280/602 |
| 3,260,531 | 7/1966 | Heavel | 280/602 |
| 3,917,298 | 11/1975 | Haff | 280/607 |
| 4,139,214 | 2/1979 | Meger | 280/607 |

FOREIGN PATENT DOCUMENTS

| | | | |
|---|---|---|---|
| 2838902 | 3/1980 | Fed. Rep. of Germany | 280/607 |

*Primary Examiner*—Charles A. Marmor
*Assistant Examiner*—Richard Camby
*Attorney, Agent, or Firm*—Stevens, Davis, Miller & Mosher

[57] ABSTRACT

The device serves to damp oscillations, vibrations, and impacts during skiing. It is mounted on the top surface of the ski and simultaneously serves as a mounting plate for the binding and as a resting surface for the ski boot. The device comprises a shock-absorbing layer of an elastomer material, a metal plate disposed thereon, which extends beyond the front and rearward ends of the elastomer layer, the end pieces of the metal plate being provided with attachments serving for mounting of the device on the ski. At the rearward end the device is screwed fast to the ski, whereas at the front end an attachment is provided such that the front end is longitudinally movable relative to the ski surface when the ski is bent. The device is additionally connected in a permanently elastic manner to the ski by a pressure-sensitive adhesive which is applied in a thick layer to the rubber substrate, whereby the damping effect is improved.

11 Claims, 3 Drawing Sheets

SHOCK-ABSORBING ELEMENT FOR SKIS

Figures 1, 2:
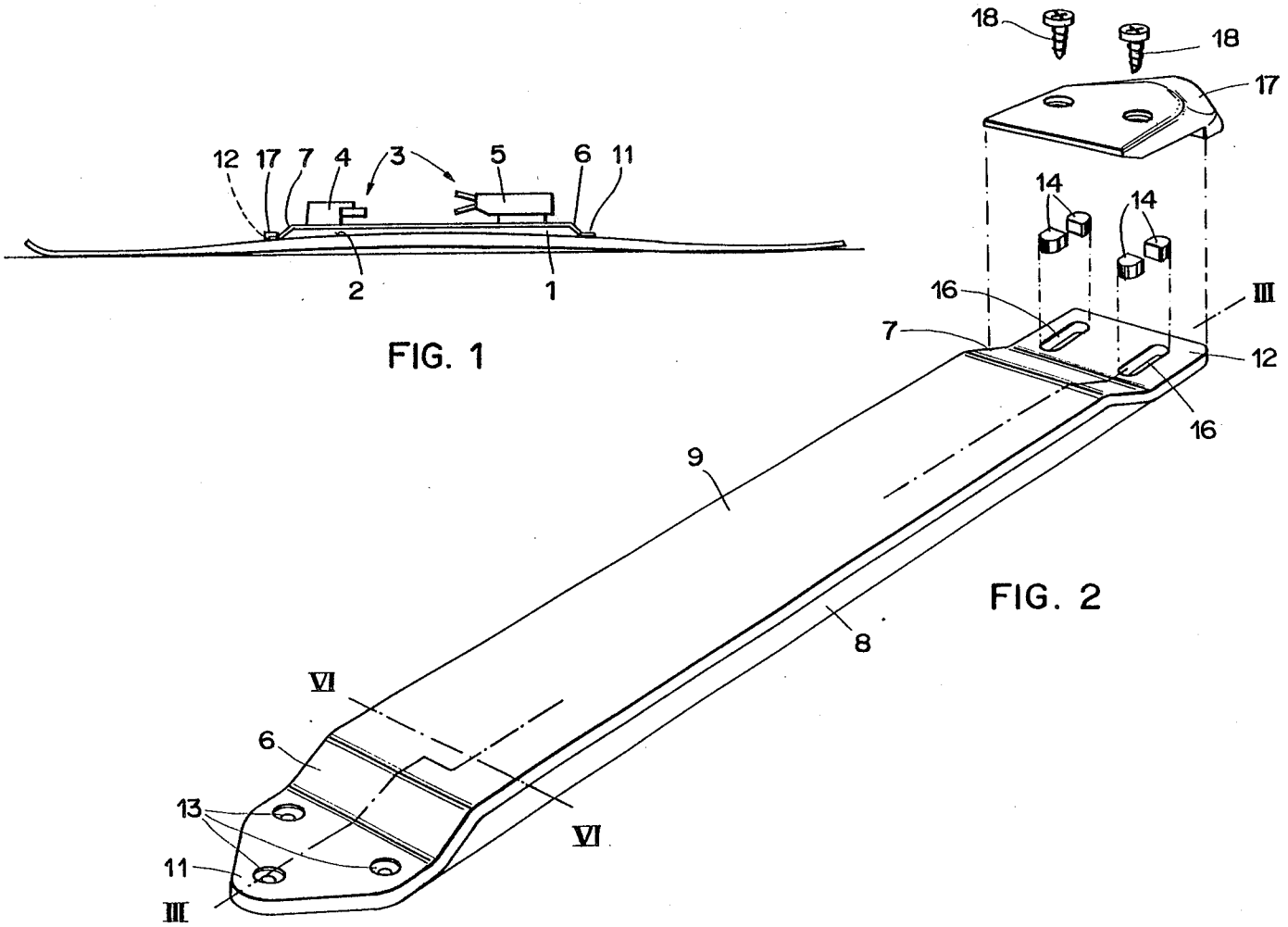

This is a continuation-in-part of application Ser. No. 915,910, filed Oct. 7, 1986, to be abandoned.

This invention relates to a device for the damping of oscillations, vibrations, and impacts during skiing, to be mounted on the top surface of a ski and simultaneously serving as a mounting plate for a ski binding and as a resting surface for a ski boot. It relates particularly to a shock-absorbing element of the type having a supporting plate of a light metal alloy and a shock-absorbing layer of a resilient material. For one thing, such an element reduces the natural oscillations and the vibration of the ski during skiing, and for another thing, impacts caused by bumpy terrain and transmitted to the skier's vertebral column are damped. Hence the device affords the skier a less fatiguing run and cuts down on accidents.

Until now, the front jaws, heel mechanism, and bearing surfaces of the ski binding have been fixed directly and rigidly to the ski. Connected thus unyieldingly, the individual elements of the ski binding have carried out their functions of fixing the ski boot to the ski and, in particular, protecting the skier from harm during a fall. However, such a rigid connection of the parts of the binding has the substantial disadvantage that upon travelling over irregular ground, impacts and vibration are transmitted directly to the skier. These phenomena not only make guidance of the skis more difficult but also have a tiring and unpleasant effect upon the skier and lead to accidents. The skier's bones, ligaments, joints, and muscles are overstressed.

Ski manufacturers have long endeavored to produce skis which do not vibrate or flutter so much during skiing. For example, it has been sought to solve the problem by affixing a layer of rubber under the edges. Later, it was also sought to damp the natural oscillations by disposing shock absorbers in the tips of the skis. During ski manufacture, other structural steps were taken to keep the natural oscillation of the skis to a minimum. It has likewise been proposed to mount plates on skis to attentuate oscillations. For instance, U.S. Pat. No. 4,294,460 to Kirsch describes a plate which is mounted on the ski by means of screws, the holes for receiving the screws in the plate being provided with resilient inserts. In these foot plates for ski bindings, relatively small rubber inserts must take on the absorption of all the vibration. Furthermore, there is a space between the binding plate and the ski which can become filled with snow and ice, producing a negative effect upon the running characteristics of the ski.

U.S. Pat. No. 3,917,298 to Haff discloses a ski-binding plate composed of a boot-receiving plate, a foam rubber layer, and a base plate. This plate is intended primarily to correct so-called canting in that the plate can be tilted laterally by tightening the fixing screws differently on the left- and right-hand sides of the ski, or by other means. The attachment of the plate described is not directed toward shock-absorption or the attenuation of vibration but rather, according to the specification, serves the sole purpose of ensuring that the inclination of the ski boot relative to the ski can be precisely adapted without snow being able to penetrate between the binding plate and the ski.

In U.S. Pat. No. 4,139,214 to Meyer, various types of devices are described which serve to attenuate impacts transmitted from the ski to the skier during skiing. In these devices, there is a space between the ski boot and the ski which can fill up with snow underway; and what is more, there is quite a long course, springs also being provided for shock-absorption. In the embodiments indicated, the heel of the boot is springingly movable vertically relative to the surface of the ski. Because of this mobility, correct transmission of the forces from the ski boot to the ski is impaired in the heel region since at least a proportion of certain forces is absorbed by the spring component.

It is an object of this invention to provide an improved device for the attenuation of oscillations, vibrations, and impacts of skis which influences the flexural characteristics of the skis as little as possible and nonetheless permits precise guidance of the skis.

A further object of the invention is to provide such a device which optimally damps impacts caused by travelling over irregular ground and the resultant vibrations of the skis, thus enabling precise and non-fatiguing skiing and protecting the skier's bones and spinal column to the greatest practicable extent.

To this end, the device according to the present invention for the damping of oscillations, vibrations, and impacts during skiing, of the type initially mentioned, comprises a shock-absorbing layer of an elastomer material as a contact area for the top surface of the ski, a metal plate disposed on the shock-absorbing layer and connected thereto, which metal plate extends beyond the shock-absorbing layer at the front and the rear thereof, the end pieces of the metal plate being substantially flush with the ski surface and having attachment means for attaching the plate to the ski, the rearward end of the metal plate having as attachment means holes which serve for its fixed mounting on the ski by means of screws, and the front end piece being provided with attachment means such that the end piece can carry out a longitudinal movement relative to the ski upon bending of the ski without the end piece being vertically or laterally movable relative to the ski, and the shock-absorbing layer is provided on its side facing the ski surface with at least one sufficiently thick layer of pressure-sensitive adhesive for the permanently elastic attachment of the shock-absorbing layer to the ski.

It is important in this connection that the layer of adhesive have a minimal thickness, sufficient elasticity, and excellent adhesion since this layer forms a connection between the extensible resilient layer and the substantially non-extensible top surface of the ski. For mounting the shock-absorbing element at the front, two elongated openings are provided there, serving to receive the screws by which the superposed cover plate is attached to the ski. This cover plate presses the metal plate against the surface of the ski. When the ski is flexed, however, the front part of the metal plate of the shock-absorbing element is movable longitudinally relative to the cover plate. The screw-receiving openings in the front part of the metal plate may be provided with resilient material to achieve additional longitudinal damping.

It has now been found that attachment of the elastomer layer by means of an adhesive is of decisive importance for the shock-absorbing effect of the inventive device. The elastomer layer preferably has longitudinally extending recesses on the underside for receiving a contact adhesive. This contact adhesive must be permanently elastic within a temperature range from about −80° C. to about +60° C. Its adhesive strength must also be ensured within this temperature range and during the life of the ski. In order for the adhesive to withstand the stresses between the elastic layer and the surface of the ski, the layer of contact adhesive must be sufficiently thick, preferably between 0.5 and 1.5 mm, optimally 1 mm. This ensures the adhesive effect even during flexing of the ski, the entire elastomer layer advantageously being able to contribute toward attenuation.

The adhesives to be utilized in attaching the elastomer layer to the surface of the ski are pressure-sensitive or contact adhesives, i.e., permanently bonding substances which, in solvent-free or dispersant-free form, spontaneously adhere to the surfaces of most materials through merely light pressure. In this connection, it is important that the contact adhesive remain permanently elastic during its entire life. For receiving this adhesive, the resilient layer is provided with recesses matching the required thickness of the layer of adhesive. Once the adhesive has been applied, it can be covered by a material coated with an anti-adhesive, such as silicone paper or siliconized polyethylene film. This film is then peeled off when the ski binding is to be mounted, so that the shock-absorbing element can be adhesively attached at the proper location. Since contact-pressure adhesives generally exhibit good resistance to briefly and rapidly occurring stresses, they are particularly well suited for the present invention.

Pressure-sensitive adhesives are known to have the tendency to "creep" under loads, especially at higher temperatures. In the inventive shock-absorbing element, this might mean that certain adhesives, particularly if applied thickly, would be pressed out from under the resilient substrate by the weight of the skier, so that the layer of adhesive would become thinner, which might lead to impairment of the adhesive effect. According to the invention, this behavior is offset by providing on the underside of the elastomer layer, as already mentioned, at least one groove, adapted to the intended thickness of the layer of adhesive, for receiving the latter. As a result, the thickness of adhesive necessary for bonding the damping element remains the same throughout the life of the ski and of the damping element attached thereto. Thus it can be ensured that the adhesive effect, and hence the shock-absorbing effect, are similarly maintained.

Adhesives which enter into consideration are, for example, contact or pressure-sensitive adhesives on the basis of natural or synthetic types of rubber in combination with modified natural, phenol formaldehyde, or hydrocarbon resins. Instead of rubber, polyacrylate, polymethacrylate, polyvinyl ether, and polyisobutene compounds may be used. Further examples of contact adhesives are compositions constituted from polyacrylic acid, polyacrylic dispersions, or of vinyl acetate copolymers and styrol butadiene or styrol isoprene block copolymers.

It has been found that adhesive attachment by means of a permanently elastic adhesive substantially improves the shock-absorbing effect of the inventive device as compared with an embodiment without adhesive attachment. A layer of adhesive which is too thin and inelastic cannot accomplish the intended purpose satisfactorily since the attachment will loosen prematurely owing to lack of elasticity upon being subjected to stress when the ski is flexed. In the present case, the contact adhesive not only serves to attach the inventive device to the ski but is also a means for transmitting the oscillation and vibration forces from the ski to the damping elastomer layer. In this way the entire elastomer layer can exert a shock-absorbing effect, which leads to the advantageous properties of the inventive element.

Since the expansion and flexural characteristics of the shock-absorbing element are different from those of the ski, and the most precise transmission of forces possible must take place nonetheless, it is important for the element to be firmly attached to the ski at the rear. The major part of the transmission of force from the skier to the ski takes place via the heel portion of the ski boot. In order that the flexural properties and the deflection curve of the ski may not be hampered by the shock-absorbing element, this element must be attached at the front in such a way that it is firmly pressed against the ski, is laterally immovable, but is longitudinally displaceable. As a rule, this is achieved by having the shock-absorbing element pressed against the ski at the front by a pressure and guidance plate secured to the ski by screws. The screws preferably pass through the front portion of the vibration-damping element, but with the holes so shaped that when the ski is flexed, a longitudinal displacement is possible. The holes may further have rubber inserts which contribute to the attenuation of oscillations.

The elastomer layer is preferably of polyurethane material but may be of some other resilient material provided it has a Shore A hardness of from 35 to 90. The polyurethane layer may also be foamed directly onto the metal plate. Normally, the resilient layer is adhesively bonded to the metal layer.

The metal plate is preferably a light metal plate, e.g., an aluminum alloy of at least one layer. However, it is also possible to make the plate of various layers. It must have sufficient strength since the ski binding is secured solely to this plate, and the latter then transmits the forces to the ski.

Figure 3:
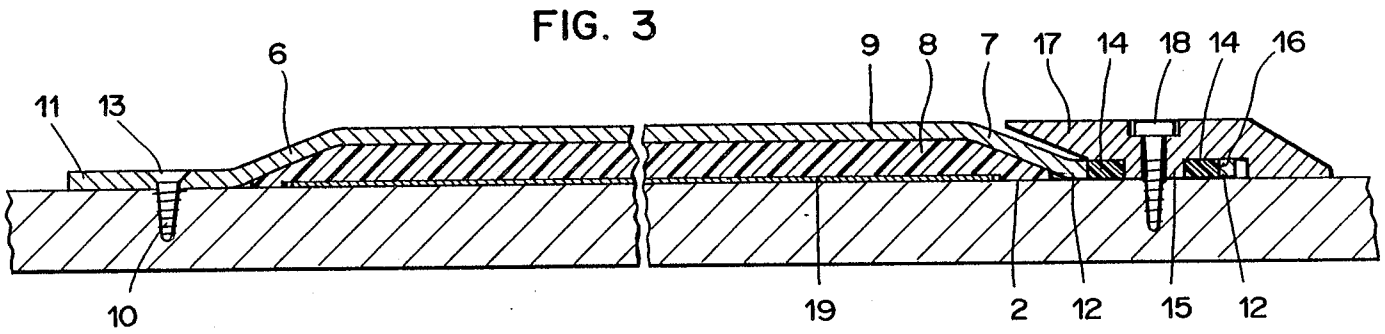
Figure 4:
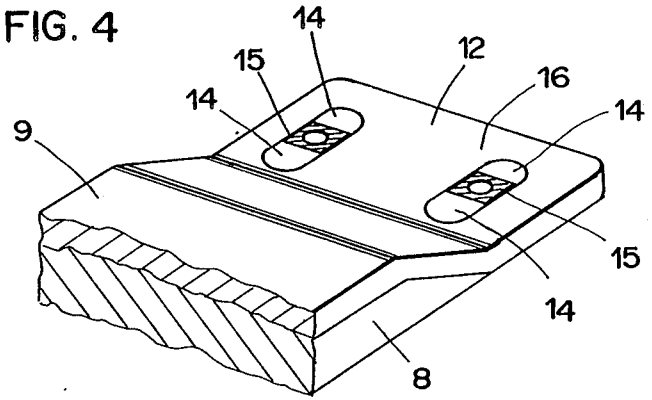
Figure 6:
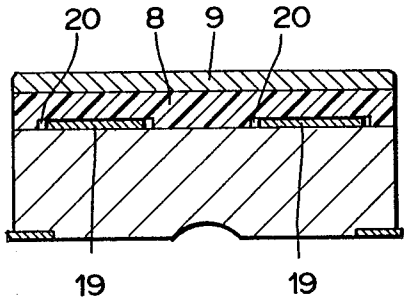
Figure 5:
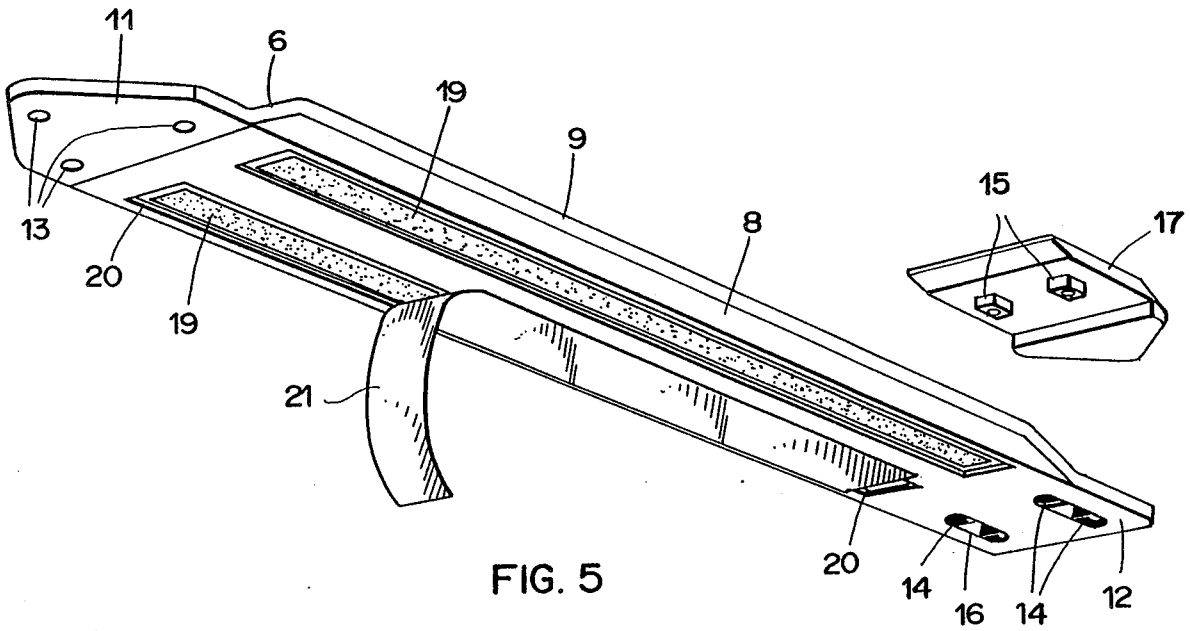

A preferred embodiment of the invention will now be described in detail with reference to the accompanying drawings, in which:

FIG. 1 is a side elevation of a ski with a shock-absorbing element according to the invention and including a mounted ski binding, FIG. 2 is an exploded perspective view of the element, FIG. 3 is a longitudinal section through the element taken on the line III—III of FIG. 2, FIG. 4 is a perspective view of the front end of the element without cover plate, FIG. 5 is a perspective bottom view of the element, and FIG. 6 is a cross-section through the shock-absorbing element taken on the line VI—VI of FIG. 2.

The manner in which the shock-absorbing element 1 is mounted on the top surface 2 of the ski may be seen in FIG. 1. A ski binding 3, comprising front clamping jaws 4 and an automatic heel mechanism 5, is then mounted on element 1. Element 1 is secured to the ski at the rearward end 11 by screws and longitudinally displaceably connected to top surface 2 at the front end 12 by means of an attachment and guiding part 17.

Details of shock-absorbing element 1 are shown in FIG. 2. Disposed on an elastomer layer 8 is a metal plate 9 having bent-down portions 6 and 7 at the front and rear. These portions merge into end pieces 11 and 12 intended to rest directly on the ski. End piece 11 includes holes 13 used in mounting element 1, while openings 16 for screws 18 in front end 12 are oval. These elongated openings 16 are provided so that front end 12 may move relative to screws 18 when the ski is subjected to bending. Attachment and guiding part 17 is pressed on front end 12 by screws 18. This arrangement prevents lateral and vertical movements of end piece 12 while allowing the desired longitudinal movement. Through co-operation between resilient pieces 14 and a guide piece 15 inserted in each of the openings 16, a supplementary damping effect is achieved. Disposed under metal plate 9, preferably made of a stable light metal alloy, is elastomer support 8, which is from 5 to 10 mm thick, preferably 8 mm and of polyurethane, and may be either adhesively bonded to plate 9 or foamed directly thereon.

FIG. 3 shows a longitudinal section through the inventive shock-absorbing element mounted on surface 2 of the ski by screws 10 and 18. Rearward end piece 11 of metal plate 9 is secured to the ski by screws 10 passing through holes 13. Disposed under plate 9 between bent-down portions 6 and 7 is elastomer layer 8. The latter has on its underside at least one groove 20 for receiving a pressure-sensitive adhesive 19. The thickness of the layer of adhesive 19 corresponds to the depth of groove 20. Preferably, the layer of adhesive 19 tops groove 20 slightly and, after mounting of elastomer layer 8, adapts itself exactly owing to the plastic properties of adhesive 19. Front end piece 12 lies directly on the ski. Alternatively, a layer of the polytetrafluoroethylene substance sold under the registered trademark "Teflon" may also be disposed between end piece 12 and ski surface 2. An opening 16, holding damping pieces 14 and guide pieces 15, is also seen in longitudinal section. Placed over end piece 12 is attachment and guiding part 17, connected to the ski by screws 18 passing through guide piece 15. By means of this arrangement, screws 18 and attachment and guiding part 17, together with the integrated guide pieces 15, are made fast to the ski. If the ski is now flexed, front end piece 12 moves longitudinally relative to the screws 18 fixed to the ski, this movement being additionally damped by the resilient parts 14.

FIG. 4 shows front end piece 12 in perspective, the arrangement of guide pieces 15 and damping inserts 14 forming part of attachment and guiding part 17 being illustrated. Guide pieces 15 are now dampingly movable longitudinally.

In FIG. 5, shock-absorbing element 1 is seen in perspective from below. A preferred arrangement of the contact adhesive locations is illustrated, pressure-sensitive adhesive 19 is contained in grooves 20 aligned longitudinally. The depth of grooves 20 corresponds to the desired thickness of the layer of adhesive 19, which is preferably about 1 mm. Grooves 20 are already filled with adhesive 19 and covered with anti-adhesive guard strips 21 during manufacture. Strips 21 are then removed prior to mounting of shock-absorbing element 1 so that contact adhesive 19 comes in contact with the top surface 2 of the ski after it has been cleaned.

It will be apparent to those skilled in the art that the best mode of carrying out the invention as illustrated in the drawing figures may be modified without departing from the spirit and principles of the inventive concept.

What is claimed is:

1. A device for the damping of oscillations, vibrations, and impacts during skiing to be mounted on the top surface of a ski and simultaneously serving as a mounting plate for a ski binding and as a resting surface for a ski boot, comprising a shock-absorbing layer of an elastomer material as a contact area for the top surface of the ski, a metal plate disposed on said shock-absorbing layer and connected thereto, which metal plate extends beyond the shock-absorbing layer at the front and the rear thereof, the end pieces of the metal plate being substantially flush with the ski surface and having attachment means for attaching the plate to the ski, the rearward end of the metal plate having as attachment means holes which serve for the fixed mounting on the ski by means of screws, and the front end piece being provided with attachment means such that the end piece can carry out a longitudinal movement relative to the ski upon bending of the ski without the end piece being vertically or laterally movable relative to the ski, and the shock-absorbing layer is provided on its side facing the ski surface with at least one sufficiently thick layer of pressure-sensitive adhesive for the permanently elastic attachment of the shock-absorbing layer to the ski.

2. The device of claim 1, wherein the pressure-sensitive adhesive contains a combination of natural and synthetic types of rubber, types of polyacrylate, polymethacrylate, polyvinyl ether, and polyisobutene, with modified natural, phenol formaldehyde, or hydrocarbon resins.

3. The device of claim 2, wherein the pressure-sensitive adhesive is a dispersion, silicone resin, or casting resin.

4. The device of claim 1, wherein the shock-absorbing layer includes on the face thereof adjacent to the ski surface at least one groove for receiving the pressure-sensitive adhesive and having a depth corresponding to the thickness of the layer of pressure-sensitive adhesive.

5. The device of claim 1, wherein the elastomer material consists of polyurethane foam and has a Shore A hardness in the range of from 35 to 90.

6. The device of claim 5, wherein the polyurethane foam is foamed directly onto the metal plate.

7. The device of claim 1, wherein the metal plate is of an aluminum alloy.

8. The device of claim 1, wherein the attachment means for attaching the front end piece to the ski surface comprises at least two screws and an attachment and guiding part including holes for the screws, and the front end piece of the metal plate includes elongated openings matching the holes and intended for receiving the screws, the dimensions of the elongated openings being such that the end piece of the metal plate is longitudinally movable relative to the attachment and guiding part and to the ski surface when the ski is bent.

9. The device of claim 8, wherein the attachment and guiding part includes guide members fitting into the elongated openings of the front end piece for preventing lateral movement of the metal plate.

10. The device of claim 8, further comprising rubber inserts disposed in the elongated openings of the front end piece of the metal plate for exerting a damping effect in co-operation with the attachment and guiding part.

11. A shock-absorbing element for a ski, said ski having longitudinal and lateral directions, said shock-absorbing element comprising:

a shock-absorbing zone disposed between an upper surface of said ski and a ski binding mounted thereon, wherein said zone includes at least one layer of an elastomer material and at least one layer of metal, said elastomer layer and said metal layer each having a rearward end and a front end, relative to the direction of travel, said elastomer layer being in direct contact with the upper surface of said ski and said metal layer being in direct contact with said elastomer layer, said metal layer sandwiching said elastomer layer between said metal layer and said upper surface of said ski;

means for rigidly fastening said rearward end of said elastomer layer and of said metal layer in the longitudinal, vertical and lateral directions during use to said ski; and at least one guiding and fastening cap including means for mounting during use said front end of said metal layer shock-absorbingly and movable longitudinally, and rigidly vertically and laterally, to said ski.

* * * * *